US010267278B2

(12) United States Patent
Tansug

(10) Patent No.: US 10,267,278 B2
(45) Date of Patent: Apr. 23, 2019

(54) HIGH PRESSURE PUMP

(71) Applicant: DELPHI TECHNOLOGIES IP LIMITED, St. Michael (BB)

(72) Inventor: Onur Mehmet Tansug, Izmir (TR)

(73) Assignee: DELPHI TECHNOLOGIES IP LIMITED (BB)

( * ) Notice: Subject to any disclaimer, the term of this patent is extended or adjusted under 35 U.S.C. 154(b) by 582 days.

(21) Appl. No.: 14/906,979

(22) PCT Filed: Jun. 30, 2014

(86) PCT No.: PCT/EP2014/063805
§ 371 (c)(1),
(2) Date: Jan. 22, 2016

(87) PCT Pub. No.: WO2015/010856
PCT Pub. Date: Jan. 29, 2015

(65) Prior Publication Data
US 2016/0160823 A1 Jun. 9, 2016

(30) Foreign Application Priority Data
Jul. 26, 2013 (GB) ..... 1313338.4

(51) Int. Cl.
*F02M 59/44* (2006.01)
*F04B 1/04* (2006.01)
(Continued)

(52) U.S. Cl.
CPC ..... *F02M 59/445* (2013.01); *F02M 59/025* (2013.01); *F02M 59/44* (2013.01);
(Continued)

(58) Field of Classification Search
CPC .. F04B 53/1022; F04B 1/0452; F04B 1/0404; F04B 53/003; F04B 37/12; F04B 53/16;
(Continued)

(56) References Cited

U.S. PATENT DOCUMENTS 6,213,094 B1 4/2001 Onishi et al.
2008/0056914 A1* 3/2008 Usui ..... F02M 55/04 417/307
(Continued)

FOREIGN PATENT DOCUMENTS

DE 102011090186 A1 7/2013
DE 102013212565 * 12/2014
(Continued)

OTHER PUBLICATIONS

Raw Machine Translation of DE102011090186, Absmeier Michael; "Device e.g. high-pressure fuel pump, for pressure increase and transferring of fluid, has damper housing or part of housing partially formed in elastically deformable manner to compensate pulsations in low pressure fluid"; Jun. 2013.*
(Continued)

*Primary Examiner* — Charles Freay
*Assistant Examiner* — Lilya Pekarskaya
(74) *Attorney, Agent, or Firm* — Joshua M. Haines

(57) ABSTRACT

A high pressure fuel pump unit includes a pump head where an inlet channel opens into a low-pressure chamber itself in fluid communication with a compression chamber. A valve is arranged so that when it is closed the fuel fills the low-pressure chamber and when the valve opens the fuel flows from the low-pressure chamber into the compression chamber. The pump head also includes a resilient member arranged so that when the valve is closed, the resilient member deforms to increase the volume of the low pressure chamber. When the valve opens, the fuel flows into the compression chamber, pushed by the resilient member which takes back its original shape.

2 Claims, 1 Drawing Sheet

(51) Int. Cl.

| | |
|---|---|
| ***F02M 59/46*** | (2006.01) |
| ***F04B 53/10*** | (2006.01) |
| ***F02M 59/02*** | (2006.01) |
| ***F04B 19/22*** | (2006.01) |
| ***F04B 53/06*** | (2006.01) |
| ***F04B 53/14*** | (2006.01) |
| ***F04B 53/16*** | (2006.01) |

(52) U.S. Cl.
CPC ..... *F02M 59/46* (2013.01); *F02M 59/464* (2013.01); *F04B 1/0404* (2013.01); *F04B 1/0452* (2013.01); *F04B 19/22* (2013.01); *F04B 53/06* (2013.01); *F04B 53/10* (2013.01); *F04B 53/1022* (2013.01); *F04B 53/14* (2013.01); *F04B 53/16* (2013.01); *F02M 2200/26* (2013.01)

(58) Field of Classification Search
CPC .. F04B 53/004; F02M 59/445; F02M 59/025; F02M 59/46; F02M 59/464; F02M 59/44; F02M 2200/26
See application file for complete search history.

(56) References Cited

U.S. PATENT DOCUMENTS

| | | | | |
|---|---|---|---|---|
| 2012/0006303 | A1* | 1/2012 | Usui ..... | F02M 55/04 123/495 |
| 2013/0098338 | A1 | 4/2013 | Usui et al. | |
| 2016/0131120 | A1* | 5/2016 | Flo ..... | F02M 55/04 417/540 |

FOREIGN PATENT DOCUMENTS

| | | | |
|---|---|---|---|
| EP | 0905374 | A1 | 3/1993 |
| EP | 1898084 | A1 | 3/2008 |
| EP | 2410167 | A1 | 1/2012 |
| JP | 2007120356 | A | 5/2007 |

OTHER PUBLICATIONS

International Search Report dated Sep. 18, 2014.

* cited by examiner

HIGH PRESSURE PUMP

CROSS REFERENCE TO RELATED APPLICATIONS

This application is a national stage application under 35 USC 371 of PCT Application No. PCT/EP2014/063805 having an international filing date of Jun. 30, 2014, which is designated in the United States and which claimed the benefit of GB Patent Application No. 1313338.4 filed on Jul. 26, 2013, the entire disclosures each are hereby incorporated by reference in their entirety.

TECHNICAL FIELD

The present invention relates to a high pressure fuel pump and more particularly to the arrangement of the inlet valve.

BACKGROUND OF THE INVENTION

In a high pressure fuel pump an inlet valve controls the filling of a compression chamber. The fuel pumped in a reservoir flows at a low pressure, few bars, through an inlet channel opening in a low-pressure chamber before filing the compression chamber of the pump. An inlet valve opens or closes the fluid communication between the two chambers.

SUMMARY OF THE INVENTION

Accordingly, it is an object of the present invention to provide a high pressure fuel pump unit having a pump head wherein an inlet channel opens into a low-pressure chamber itself in fluid communication with a compression chamber. The fluid communication is controlled by a valve arranged so that when it is closed the fuel fills the low-pressure chamber and when the valve opens the fuel flows from the low-pressure chamber into the compression chamber. The pump head advantageously further comprises a resilient member, arranged so that when the valve is closed, the resilient member deforms increasing the volume of said low-pressure chamber and, when the valve opens the fuel flows into the compression chamber pushed by the resilient member, which takes back its original shape.

The low-pressure chamber has a plurality of peripheral walls, the resilient member being one of said walls. In particular, the low-pressure chamber is defined within a top cap fixed to the housing of the pump head. The top cap has a cylindrical wall, extending away from the pump housing, the resilient member being a transversal top wall. The top cap is made from a thin metal sheet, so the transversal top wall is flexible and forms the resilient member.

Alternatively, the pump unit may further comprise a flange fixed on the pump head, said flange being provided with a through bore forming the lateral walls to the low-pressure chamber, said bore being closed by the resilient member. The bore is provided with an internal thread so to receive a threaded cap in abutment against an internal shoulder face. The resilient member is an elastic membrane stretched between the shoulder and the cap.

The face of the inner face of the cover is provided with a recess defining a complementary chamber between said concave face and the membrane.

The pump unit is further provided with a vent hole joining the complementary chamber to the outside.

BRIEF DESCRIPTION OF THE DRAWINGS

The present invention is now described by way of non-limiting examples with reference to the accompanying drawings in which.

DESCRIPTION OF THE PREFERRED EMBODIMENTS

For clarity and concision purposes and to ease the understanding of the description a bottom-up orientation as shown in the figures will be used. The terms top, bottom, upper, lower . . . as well as the orientations downward, downwardly, upward, upwardly may be utilized.

Figure 1:
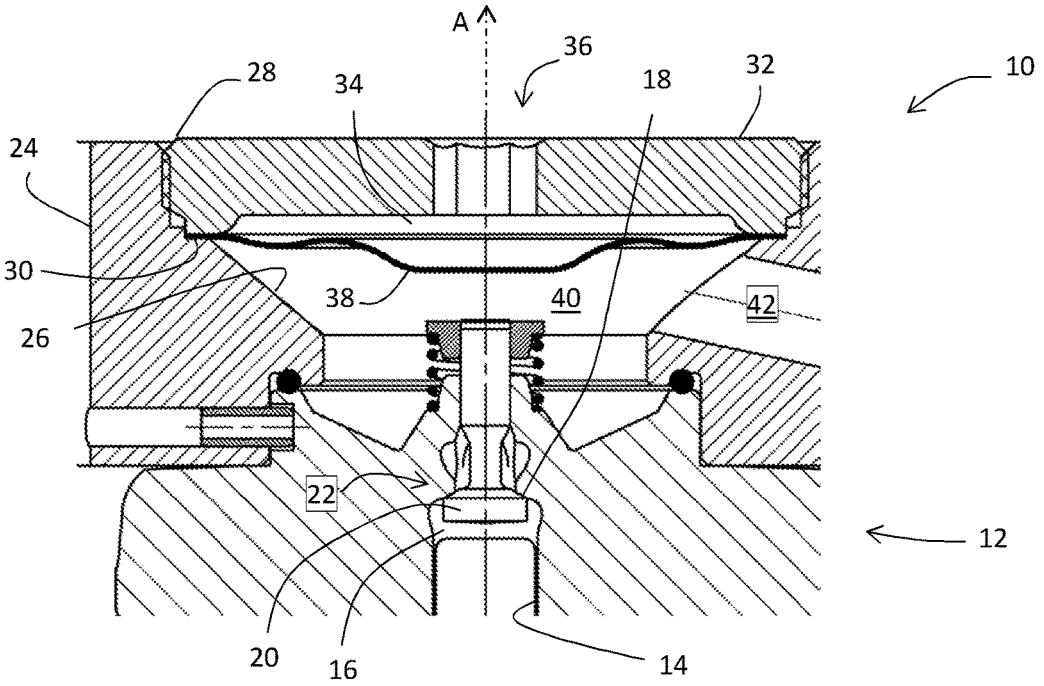
FIG. 1 is an axial section of a pump head as per the invention.

A first embodiment of the invention is now described in reference to FIG. 1 where the head 12 of a high pressure fuel pump 10 is represented. The pump head 12 is provided with a bore 14 wherein a piston reciprocally slides along a main axis A. The upper portion of the bore 14 defines a compression chamber 16, the very top of which closing to form the seat 18 of a poppet valve 20 that controls a fluid path 22. The valve 20 is normally closed as it is solicited in abutment against the seat 18 by a spring.

Over the pump head 12 is fixed a flange 24 provided with a through hole upwardly extending along the main axis A. This hole extends in a conical portion 26 having an upwardly enlarging section that ends in a cylindrical threaded section 28. An O-ring arranged between the pump housing and the flange 24 seals the assembly. A shoulder face 30 is formed between the conical portion 26 and the cylindrical threaded section 28. A threaded cap 32 is complementary arranged into the cylindrical threaded section 28 and is tightened to abut against the shoulder face 30. The inner surface of the cap 32 is provided with a recess 34 from which a vent hole 36 extends throughout the cap 32 and opens on the outside. In between the shoulder face 30 and the cap 32 is stretched a flexible membrane 38 separating the conical portion 26 that defines a low-pressure chamber 40 and the recess 34. The pump head 12 is further provided with an inlet channel 42 that opens in the low-pressure chamber 40.

The operation of the pump 10 is now described. In a first phase, the valve being closed, the fuel is pumped in a reservoir by an electric pump and it flows in the inlet channel 42 until arriving into the low-pressure chamber 40. The fuel, at a few bars pressure, fills the low-pressure chamber 40 and deforms the flexible membrane 38 so to maximize the occupied volume. The air in the recess 34 exits via the vent hole 36.

In a second phase the valve 20 opens as the piston displaces downwardly and depressurizes the chamber 16. The fuel contained in the low-pressure chamber 40 flows in the compression chamber 16 as it is on one side sucked by the depression and on the other side pushed by the membrane 38 that tends to come back to a minimum stretched position as represented on FIG. 1. Thanks to this dual action, the filling of the compression chamber 16 is optimized.

Figure 2:
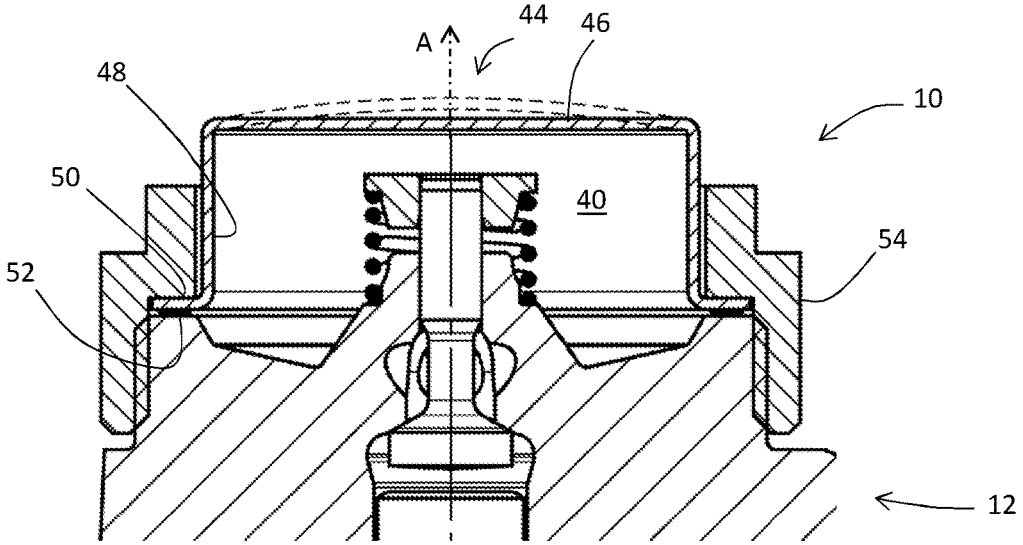
FIG. 2 is a second embodiment of a pump head still as per the invention.

A second embodiment of the invention is now described in reference to FIG. 2. The main difference with the first embodiment is that over the pump head 12 the flange 24 is removed and replaced by a top cap 44 that has the general shape of a top hat. The top cap 44 is made from a punched metal sheet and it is provided with a transversal top wall 46 from the periphery of which downwardly extends a cylindrical peripheral wall 48 until forming a transversal disc-shape peripheral foot 50. The foot 50 is arranged against a complementary flat face 52 of the pump head 12 so defining the low-pressure chamber 40 under the top cap 44. A large nut 54 provided with an inwardly extending portion is complementary arranged on the pump head 12 and maintains the foot 50 in sealed connection against the flat face 52. The top cap 44 is punched in a thin metal sheet providing elastic properties so it deforms when the valve 20 closes and the fuel at a few bars pressure flows in the low-pressure chamber 40. A deformed top cap is represented in dotted lines in FIG. 2.

Numerous alternatives can be derived from the described embodiments where the core of the invention resides in the flexible surface that stretches enabling to increase the internal volume of the low-pressure chamber when the fuel enters said chamber.

The invention claimed is:

1. A high pressure fuel pump unit comprising:

a pump head with an inlet channel which opens into a low-pressure chamber, the low-pressure chamber being in fluid communication with a compression chamber;

a valve which controls the fluid communication between the low-pressure chamber and the compression chamber so that when the valve is closed, fuel fills the low-pressure chamber and when the valve is open, fuel flows from the low-pressure chamber into the compression chamber;

a resilient member arranged so that when the valve is closed, the resilient member deforms, thereby increasing the volume of the low-pressure chamber and when the valve is open, fuel flows into the compression chamber pushed by the resilient member which takes back its shape prior to being deformed to increase the volume of the low-pressure chamber; and a flange fixed on the pump head, the flange being provided with a through bore forming lateral walls to the low-pressure chamber, the through bore being closed by the resilient member, wherein the through bore is provided with an internal thread so to receive a threaded cap and wherein the through bore is also provided with a shoulder face located within the through bore, the resilient member being an elastic membrane captured between the shoulder face and the threaded cap, and wherein the threaded cap is provided with a recess defining a complementary chamber between the recess and the elastic membrane; and wherein the high pressure fuel pump unit is further provided with a vent hole joining the complementary chamber to the outside; and wherein the elastic membrane contacts the shoulder face and the threaded cap.

2. A high pressure fuel pump unit as set in claim 1, wherein the elastic membrane contacts the threaded cap on a threaded cap surface such that the elastic membrane is interposed between the shoulder face and the threaded cap surface.

* * * * *